United States Patent [19]

Swift

[11] Patent Number: 4,506,415

[45] Date of Patent: Mar. 26, 1985

[54] SECURITY SEAL AND TAG HOLDER

[75] Inventor: Allan W. Swift, Denville, N.J.

[73] Assignee: E. J. Brooks Company, Newark, N.J.

[21] Appl. No.: 516,653

[22] Filed: Jul. 25, 1983

[51] Int. Cl.[3] ..... B65D 63/00; B65D 27/30

[52] U.S. Cl. ..... 24/16 PB; 24/30.5 R; 24/30.5 P; 40/21 C; 292/318; 292/321

[58] Field of Search ..... 24/30.5 P, 30.5 R, 30.5 L, 24/16 PB, 17 AP; 40/21 C; 292/318, 321

[56] References Cited

U.S. PATENT DOCUMENTS

| | | | |
|---|---|---|---|
| 2,440,012 | 4/1948 | Haver | 24/30.5 R |
| 2,977,145 | 3/1961 | Rifkin | 292/321 |
| 3,009,220 | 11/1961 | Fein | 24/16 PB |
| 3,581,347 | 6/1971 | Verspieren | 24/16 PB |
| 3,983,604 | 10/1976 | Phillips | 24/16 PB |
| 4,008,512 | 2/1977 | Prodel | 24/16 PB |
| 4,263,697 | 4/1981 | Speedie | 24/30.5 L |
| 4,306,745 | 12/1981 | Wenk | 292/318 |
| 4,333,210 | 6/1982 | Burnett | 24/30.5 P |

FOREIGN PATENT DOCUMENTS

| | | | |
|---|---|---|---|
| 948900 | 2/1964 | United Kingdom | 24/30.5 P |
| 1346793 | 2/1974 | United Kingdom | 40/21 C |

*Primary Examiner*—Victor N. Sakran

*Attorney, Agent, or Firm*—Robert E. Ross

[57] ABSTRACT

A combination security seal and identification tag holder for assembly onto the neck of a mail bag or the like, in which a shackle locking mechanism is provided with a housing having a locking plug which is inaccessible when the seal is assembled onto the bag, and is prevented by the gathered neck of the bag from moving out of the locking position. The assembly includes an integral tag receiving member positioned to protrude from the bag into a visible position when the seal is assembled.

4 Claims, 8 Drawing Figures

SECURITY SEAL AND TAG HOLDER

BACKGROUND OF THE INVENTION

In the handling of mail bags and similar containers which must be sealed against pilfering and must have an identification tag attached, it has been customary to apply a security seal to the hasp and to attach a separate tag for carrying indentification information. Such bags are customarily provided with a leather strap stitched to the bag, the ends of said strap carrying a hasp and a staple to receive a seal or a lock. A security seal is often applied to the staple to maintain the hasp in the closed position, and a separate identification tag is fastened to the staple. It is therefore possible to change the identification tag without changing the seal.

SUMMARY OF THE INVENTION

In accordance with this invention, a security seal is provided which is capable of maintaining the neck of a mail bag in the closed condition, and cannot be removed without rupturing and thereby giving an indication of tampering, so that it serves both as a bag closure and a security seal. In a preferred embodiment of the invention the device is also provided with a tag receiving member which is integral with the seal portion of the device. Also, in a preferred embodiment of the invention, the shackle is provided with means for cooperating with the shackle locking mechanism to help retain the locking mechanism in the locked condition.

DESCRIPTION OF THE ILLUSTRATED EMBODIMENT

Figure 1:
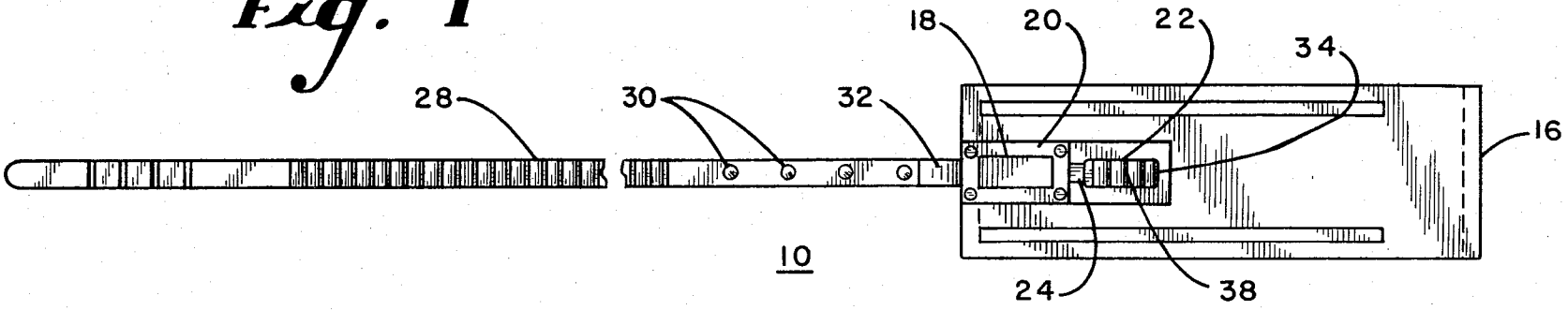
FIG. 1 is a top plan view of a combination seal, bag closure, and identification tag holder embodying the features of the invention.

Referring to the drawing, there is illustrated a combination seal, bag closure, and tag holder 10 which is adapted for assembly around the gathered neck 12 of a mail bag 14 or the like.

The seal 10 is designed to maintain the neck 12 in the closed condition during handling and to serve as a security seal, in that the seal must be destroyed to remove it from the bag. In the preferred embodiment of the invention, an integral tag holder 16 is provided as an integral part of the device to receive an identifying tag as will appear hereinafter.

The tag holder 16 serves as a base on which a shackle locking housing 18 is positioned, said housing having side walls 20 and a top cover 22 which, in the as molded condition, is attached to one end of the top of the body by a hinge 24 and extends away from the housing.

Attached to the other end of the housing 18 is a shackle 26 having locking ribs 28, bag engaging projections 30 and an abutment 32 near the junction with the housing for a purpose to appear hereinafter.

Figure 2:
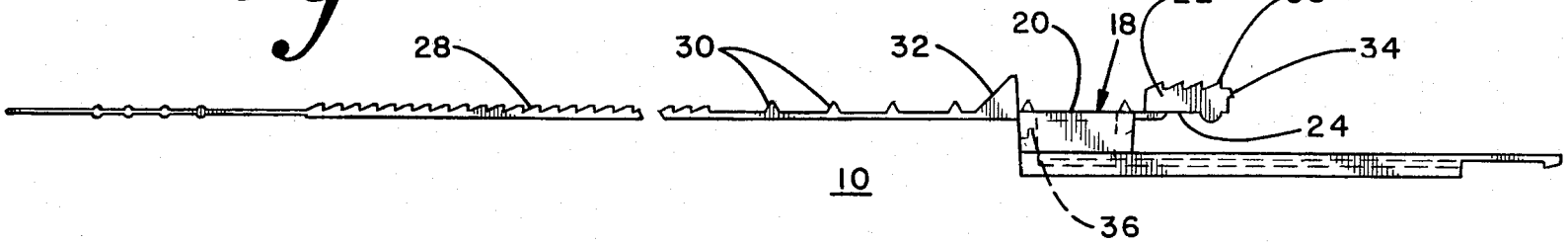
FIG. 2 is a view of the device of FIG. 1 as seen from the side.
Figure 3:
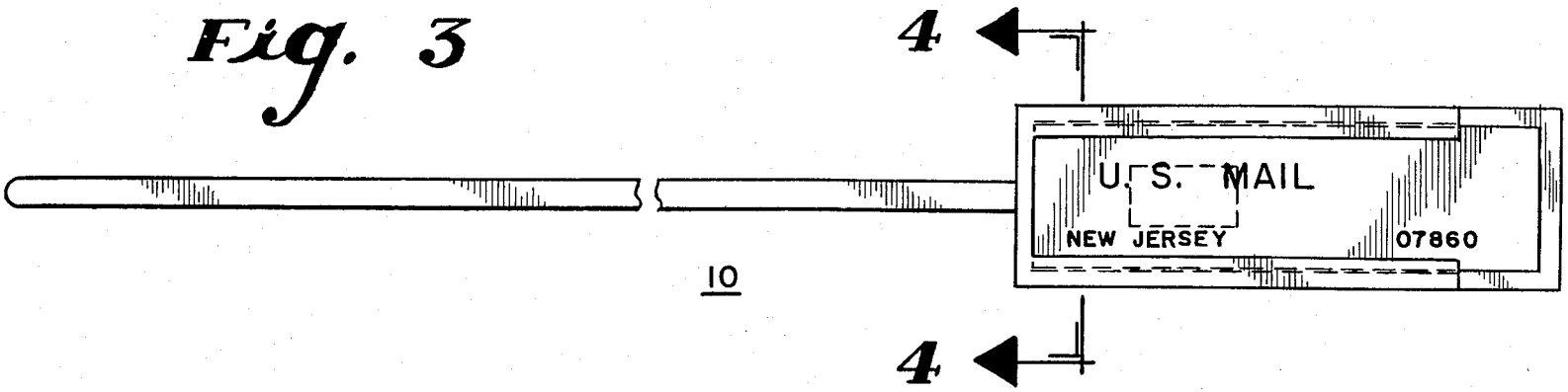
FIG. 3 is a view of the device of FIG. 2 as seen from the bottom.
Figure 4:
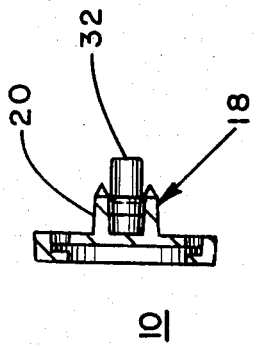
FIG. 4 is a view in section taken on line 4—4 of FIG. 2.
Figure 5:
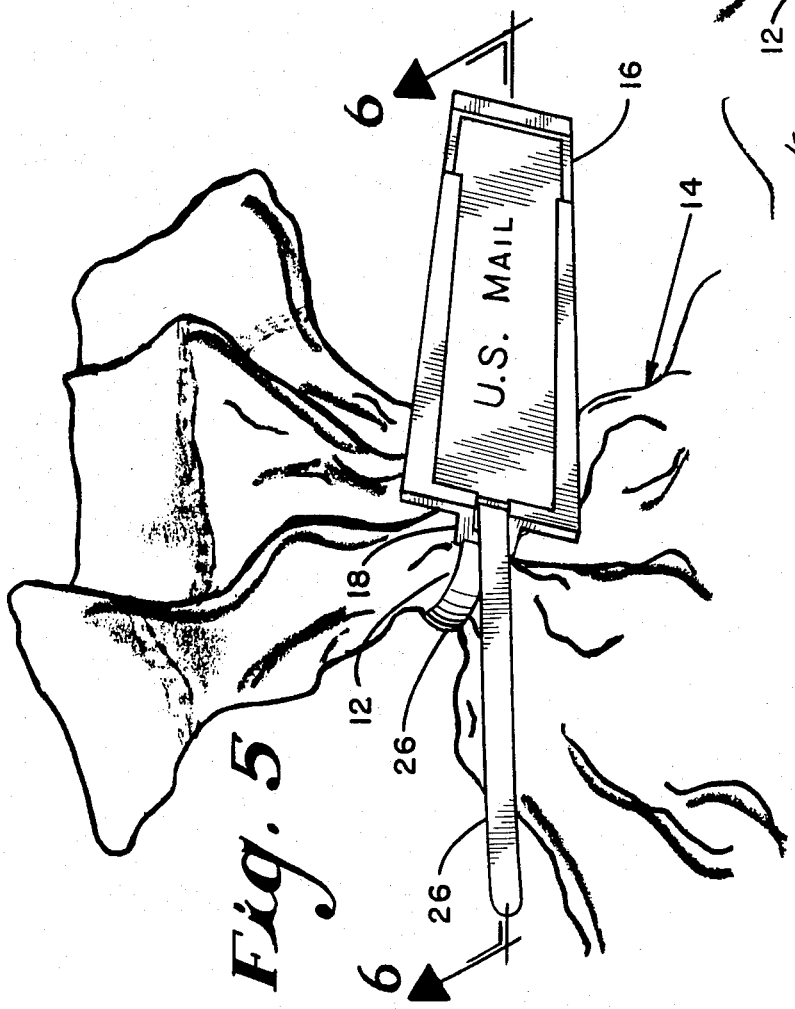
FIG. 5 is a view of the seal of FIGS. 1–4 assembled onto the gathered neck of a bag.
Figure 6:
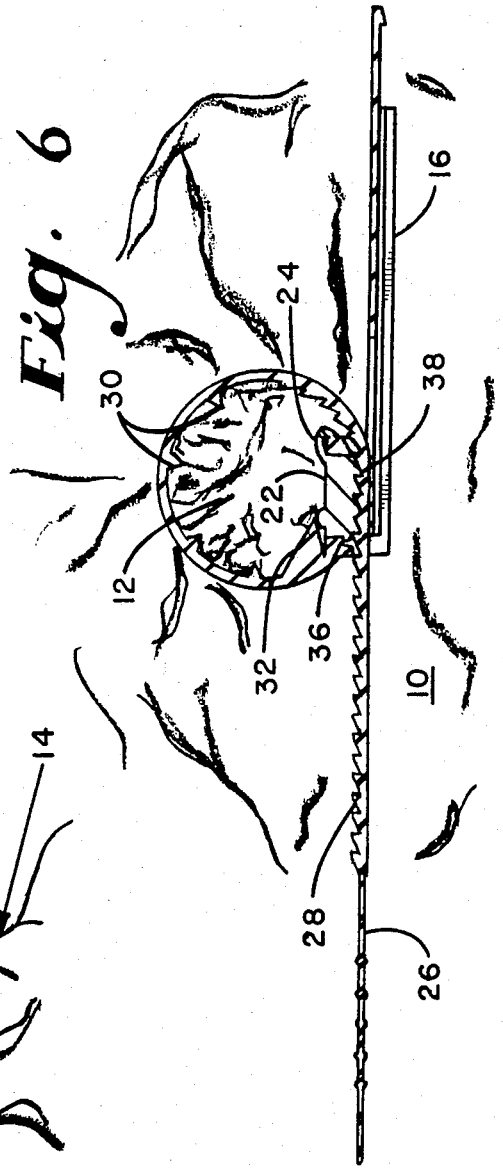
FIG. 6 is a view in section taken on line 7—7 of FIG. 5.
Figure 7:
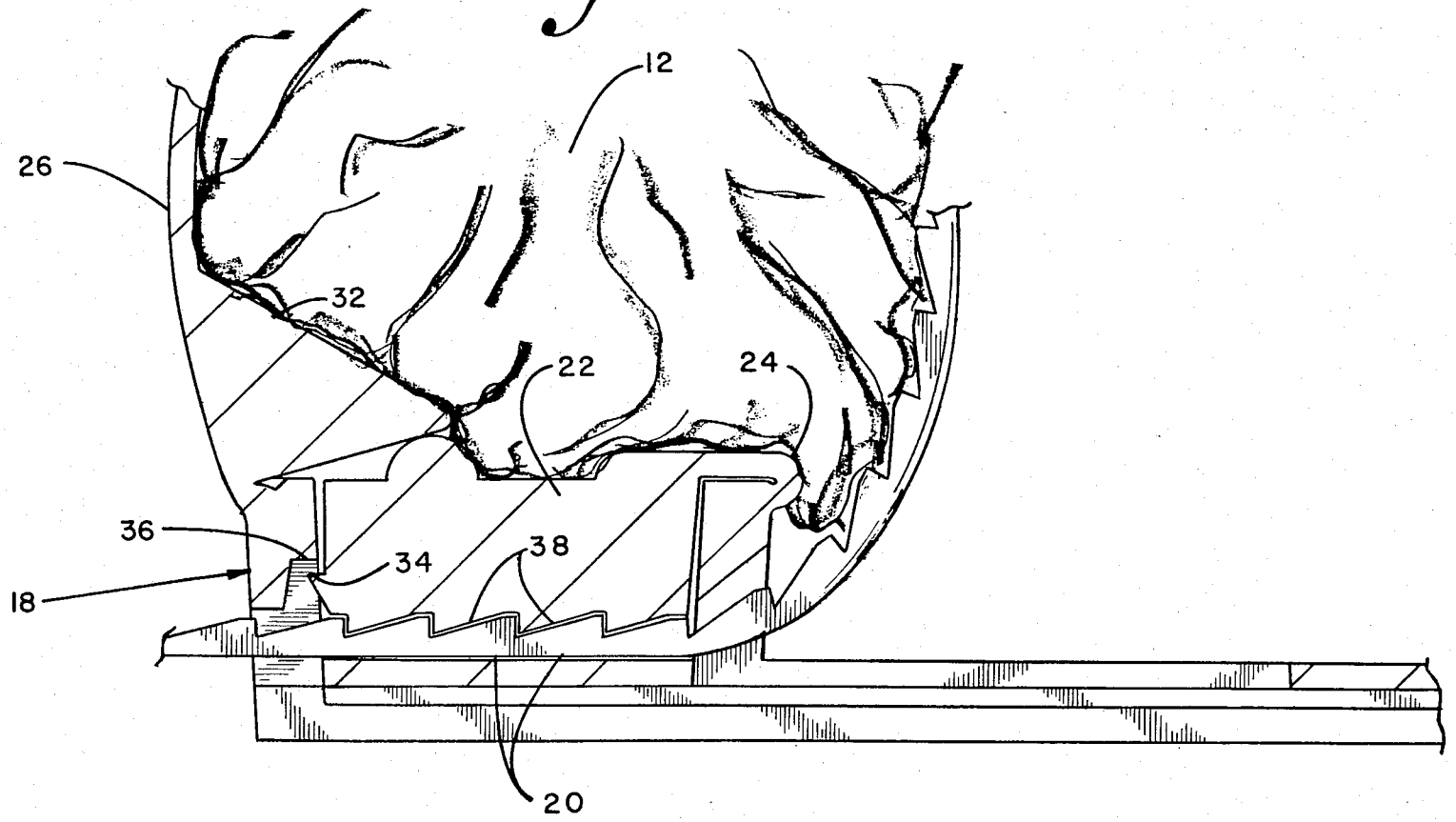
FIG. 7 is an enlarged view of the locking mechanism in the locked position as illustrated in FIG. 6.

The seal is illustrated in FIGS. 1–3 in the as molded condition. To prepare the seal for use, the cover 22 is rotated about the hinge 24 into the top of the housing 18, where it latches into engagement by means of a projection 34 engaging behind a shoulder 36. (See FIG. 5).

The device may then be assembled onto the gathered neck 12 of the bag by placing the housing 18 against the bag, wrapping the shackle around the bag, and inserting the end of the shackle into the space between the bottom of the housing and the underside of the cover 22 and pulling it tight. To enable the shackle to be maintained in the tightened condition, he under side of the cover 22 is provided with ratchet teeth 38 which engage with the ratchet teeth 28 on the shackle to prevent reverse movement of the shackle after tightening.

To insure that the cover cannot become disengaged from the housing, either inadvertently, or deliberately by a person attempting to tamper with the seal, the abutment 32 is so dimensioned and positioned on the shackle that when the seal is assembled, the abutment extends over and bears against the adjacent end of the cover 22, which may be provided with an embossment 40 positioned and dimensioned to be contacted by the abutment 32. The cover therefore cannot be lifted to allow disengagement of the seal without removal of the abutment, which would require removal of the shackle.

Figure 8:
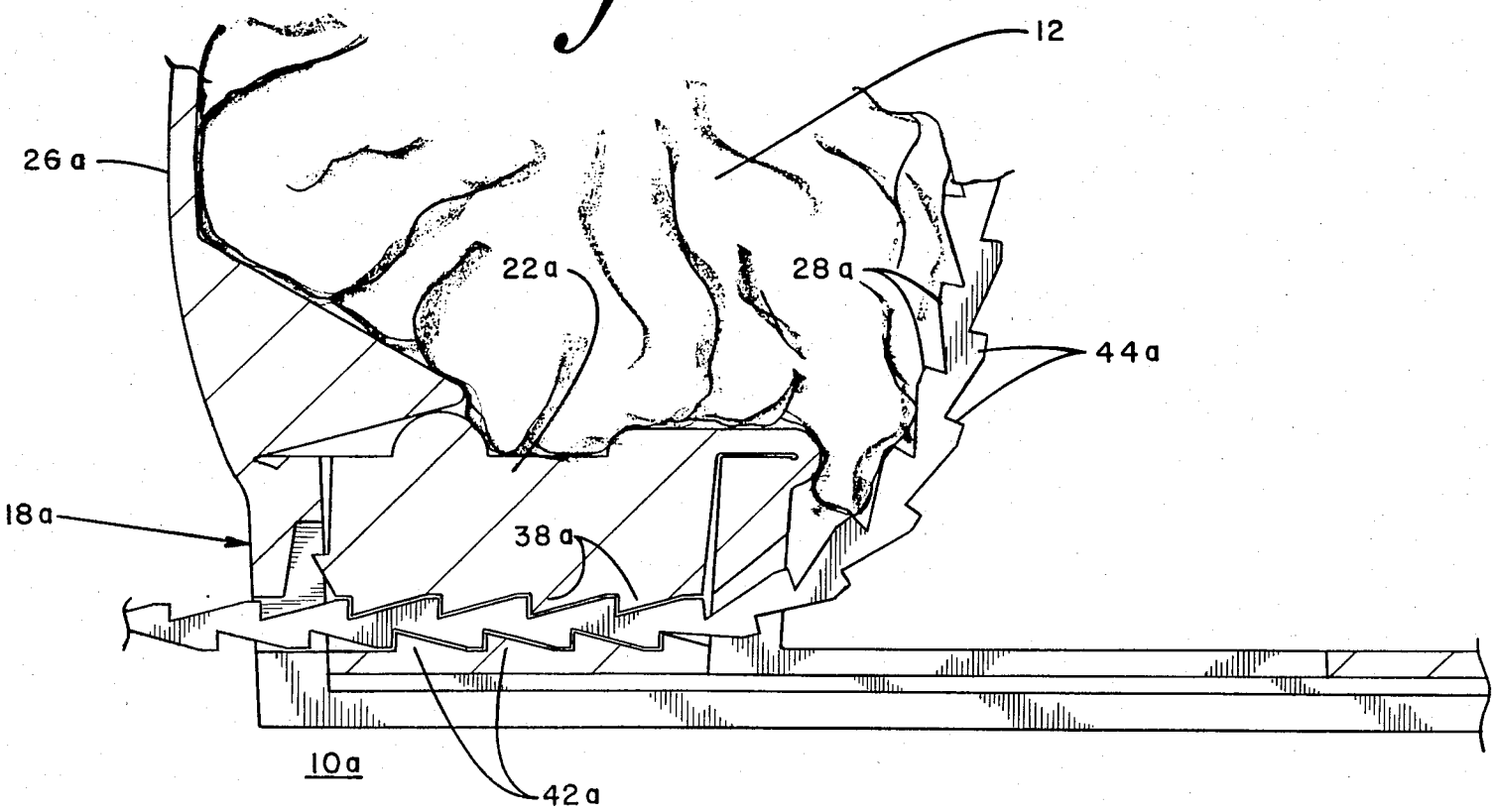
FIG. 8 is a view similar to FIG. 7 of a modified form of locking mechanism.

Referring to FIG. 8, there is illustrated another embodiment of the invention, in which a seal **10*a*, similar to seal 10, is provided with a housing 18*a* which has a cover 22*a* having ratchet teeth 38*a*, as in the embodiment of FIGS. 1–7, and also has ratchet teeth 42*a* on the bottom of the housing. The shackle 26*a* not only has ratchet teeth 28*a* on the upper or inner surface, but also has ratchet teeth 44*a* on the outer surface, so that after assembly the shackle 26*a*** is locked in the housing on both inner and outer surfaces.

Since certain other changes obvious to one skilled in the art may be made in the illustrated embodiment of the invention without departing from the scope thereof, it is intended that all matter contained herein be interpreted in an illustrative and not a limiting sense.

I claim:

1. A security seal comprising a housing formed by side walls and a top, said top being hinged to the side walls and movable about the hinge from an initially open position to a closed position, said housing and said top having latch means for retaining the top in the closed position, and a shackle extending from the housing, said shackle being insertable through the housing to form a shackle loop, said shackle and said housing having interengaging means for preventing reverse movement of the shackle after it has been pulled through the housing, in which said shackle has means positioned and dimensioned to bear against the top of the housing to maintain said top in the closed position when the shackle is drawn through the housing.

2. A combination bag closure, identification tag holder, and security seal formed of molded plastic, said device being adapted for assembly onto the gathered neck of a bag and comprising a tag holder having tag retaining means thereon, a housing formed on one end of the tag holder, said housing having a passageway therethrough, and a shackle extending from the housing, said shackle being dimensioned to be insertable through the housing passage, said shackle and said housing having cooperating ratchet means for preventing reverse movement of the shackle through the housing, a top portion of said housing being connected to the remainder of said housing by a flexible hinge and being molded in the open position, said top and the remainder of said housing having latch means to retain the top in the closed position, said top and the shackle having means positioned and dimensioned to cause the shackle to bear against the top when the shackle is pulsed through the housing to retain the top in the closed position.

3. A seal comprising a housing formed by side walls, end walls, and a top, said top being hinged at one end to one end wall and being movable about the hinge from an initially open position to a closed position, the other end of the top and a wall portion having coopersting latch means for retaining the top in the closed position, and a shackle extending from the end of the housing opposite the said one end, said housing having an aperture in each end wall to allow the shackle to pass therethrough, said shackle and said housing having interengaging means to prevent reverse movement of the shackle after it has passed through the housing, said shackle having means for bearing against the top of the housing at said other end thereof when the seal is assembled to maintain the top in the closed position.

4. A seal as set out in claim 3 in which said other end of the top and the portion of the shackle adjacent the housing have projections which abut each other when the seal is assembled.

* * * * *